US006596933B2

(12) United States Patent
Vaughn

(10) Patent No.: US 6,596,933 B2
(45) Date of Patent: Jul. 22, 2003

(54) PERCUSSION INSTRUMENT MOUNTING APPARATUS

(76) Inventor: Ronald Warren Vaughn, 1451 Stafford Rd., Ottawa, KS (US) 66067

( * ) Notice: Subject to any disclaimer, the term of this patent is extended or adjusted under 35 U.S.C. 154(b) by 0 days.

(21) Appl. No.: 09/997,635

(22) Filed: Nov. 29, 2001

(65) Prior Publication Data

US 2002/0121176 A1 Sep. 5, 2002

Related U.S. Application Data

(60) Provisional application No. 60/253,814, filed on Nov. 29, 2000.

(51) Int. Cl.[7] ..... G10D 13/08

(52) U.S. Cl. ..... 84/402; 84/403; 84/421; 84/411 P

(58) Field of Search ..... 84/402, 403, 421, 84/411 P

(56) References Cited

U.S. PATENT DOCUMENTS

| | | | | | |
|---|---|---|---|---|---|
| 641,901 | A | * | 1/1900 | Soistmann | 84/411 R |
| 1,346,588 | A | * | 7/1920 | Bower | 84/465 |
| 3,780,613 | A | * | 12/1973 | Ludwig, Jr. | 84/421 |
| 4,898,061 | A | * | 2/1990 | Cohen et al. | 84/402 |
| 5,600,080 | A | * | 2/1997 | Belli | 84/421 |
| 5,932,823 | A | * | 8/1999 | Jacobs | 84/411 P |

* cited by examiner

*Primary Examiner*—Shih-Yung Hsieh

(57) ABSTRACT

A percussion instrument mounting system comprising a connector means preferably and elastically flexible cord or plurality of cords, each having a first end attached to a percussion instrument such as a woodblock, and a second end attaching to a vibration absorbing material or to a rigid frame or support upon which the vibration absorbing material rests or is thereby supported. The elastic cord draws the percussion woodblock and the vibration absorbing material together into a flexibly fixed position so that the instrument is playable.

7 Claims, 9 Drawing Sheets

PERCUSSION INSTRUMENT MOUNTING APPARATUS

This application claims the benefit of the prior filed, co-depending provisional application Ser. No. 60/253,814 filed Nov. 29, 2000, entitled Tetherflex™ Percussion Instrument Mounting System.

BACKGROUND OF THE INVENTION

1. Field of the Invention

The present invention relates to support systems, and more particularly, to an assembly for holding musical percussion instruments, particularly woodblocks, but which can be easily adapted for other idiophones and membranophones by someone skilled in the art.

2. Description of the Prior Art

Mounting percussion instruments and drums for better resonance has been and remains a common goal among designers. Much focus has been given to the improvements for mounting drums—for example U.S. Pat. No. 641,901 to Soistmann, and U.S. Pat. No. 3,780,613 to Ludwig, Jr., and U.S. Pat. No. 5,600,080 to Belli, all for drum mounting ideas. For smaller percussion instruments, often referred to as 'hand held' instruments, there has not been as great an effort.

In recent years many of the authentic smaller percussion instruments like woodblocks are being reproduced using synthetic materials, plastics. While these innovation improve durability, much of the full, rich sound quality produced by the original authentic instruments is lost. The difference in mounting designs of instruments made of such durable synthetic materials and those made of naturally occurring materials can be seen in U.S. Pat. No. 4,898,061 to Cohen.

The commonly accepted method for mounting authentic woodblocks today remains a clamp design that dates back to the beginning of 'modern' percussion hardware. These require that the woodblock be drilled with mounting holes on the underside or on the ends, where metal forks are inserted, allowing the block to be loosely mounted. In this way, the block is free to move in ways not helpful to the player. An even greater drawback is that a large portion of the instrument's resonance is grounded through this direct contact between a ridged metal support system and the instrument body. In turn, the clamp itself is fastened to ancillary parts that eventually lead to the floor surface on which the entire assembly rests. Much of the instrument's sound goes to the floor. These metal clamps are still in active production today, supporting the fact that even with these limitations, many players still prefer the natural sound of wood.

SUMMARY OF THE INVENTION

The present invention, a musical instrument mounting assembly, comprises an attachment means, a vibration absorbing material, and an elective rigid frame or support assembly. The mounting assembly includes a frame structure with a cradle assemble coupled thereto. The cradle assembly is constructed of a vibration absorbing material and is configured to support a musical instrument such as a woodblock. An elastically flexible cord is connected at one end to a percussion instrument for gently holding the instrument in contact with the form cradle so that the instrument is playable with maximum sound resonance.

OBJECTS AND ADVANTAGES

A general object of the present invention is to provide a superior mounting assembly for a musical hand-held percussion instrument, such as but not limited to a musical woodblock, which is to be supported for use by a player in such a way that the woodblock will remain free to fully resonate.

Another object of the present invention is to provide additional protection from physical damage by way of softening or cushioning the impact of heavier mallet stokes from the player.

Still another object of the present invention is to further free the natural tonal sound of an instrument such a woodblock so that the pitch fundamental and accompanying overtones can be heard more completely.

Still another object of the present invention is to decrease the amount of force a player must use to achieve a louder sound because the majority of the players energy is converted to sound by the flexible assembly.

Yet another object of the present invention is to improve the tone quality of instruments when the performer desires a volume level of mezzo piano or less, i.e., the instrument is unencumbered by direct contact with rigid mounting so that substantial vibration of the instrument occurs even when the player applies a very light stroke with a stick or mallet.

Yet another object of the present invention is to allow a player the freedom to position instrument in the most advantageous arrangement to match his or her personal performance requirements, including angles that are steep or vertical, as well as inverted positions, without sacrificing sound quality.

REFERENCE NUMERALS IN DRAWINGS

Figure 1:
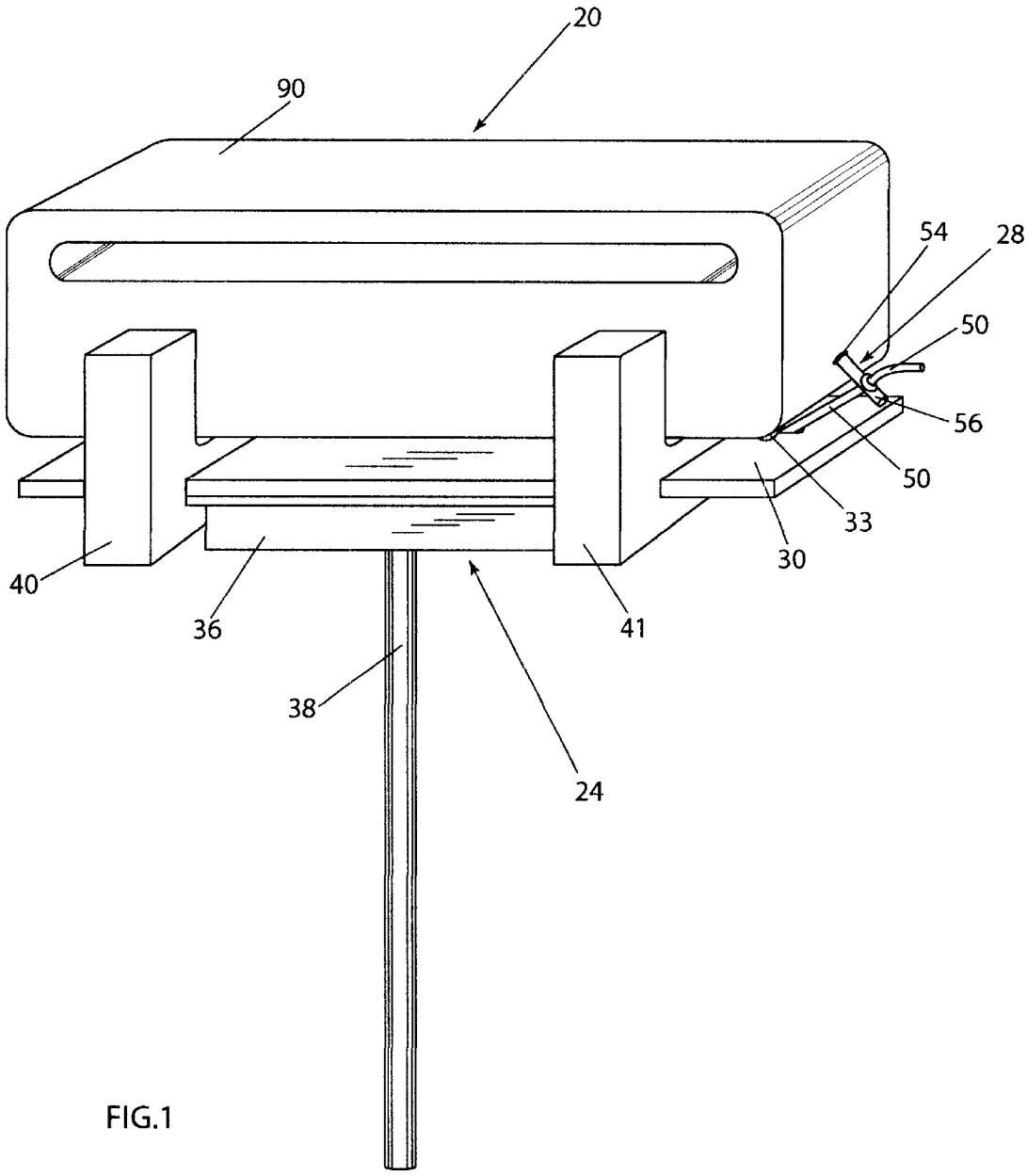
FIG. 1 is a perspective view of a preferred embodiment complete assembly of the present invention including a musical woodblock in playable position.

20 musical woodblock and attachment means assembly
24 't' base support plate assembly
28 tether assembly
30 'T' base plate

32 keyslot through-hole, left facing
33 keyslot through-hole, right facing
36 90° angle support for base plate
38 round rod stern
40 vibration absorbing foam cradle
41 vibration absorbing foam cradle
42 slit
43 foam cradle uprights
50 multistranded rubber cord with nylon sheath
51 drilled through-hole in detent pin
52 drilled blind-hole for detent pin sleeve in woodblock
54 detent pin sleeve
56 detent pin
57 spring loaded ball
70 solid foam block with rectangular woodblock recess
72 through-hole to pass elastic tether 50
74 counter sunk hole to receive washer
76 washer
80 solid foam panel with two through-hole interior rectangular cutouts
84 solid foam panel with through-holes
86 rigid anchor panel with keyslot through-holes
88 solid foam panel pad
89 rigid box
90 musical percussion woodblock

DETAILED DESCRIPTION OF THE PREFERRED EMBODIMENT

Figure 5:
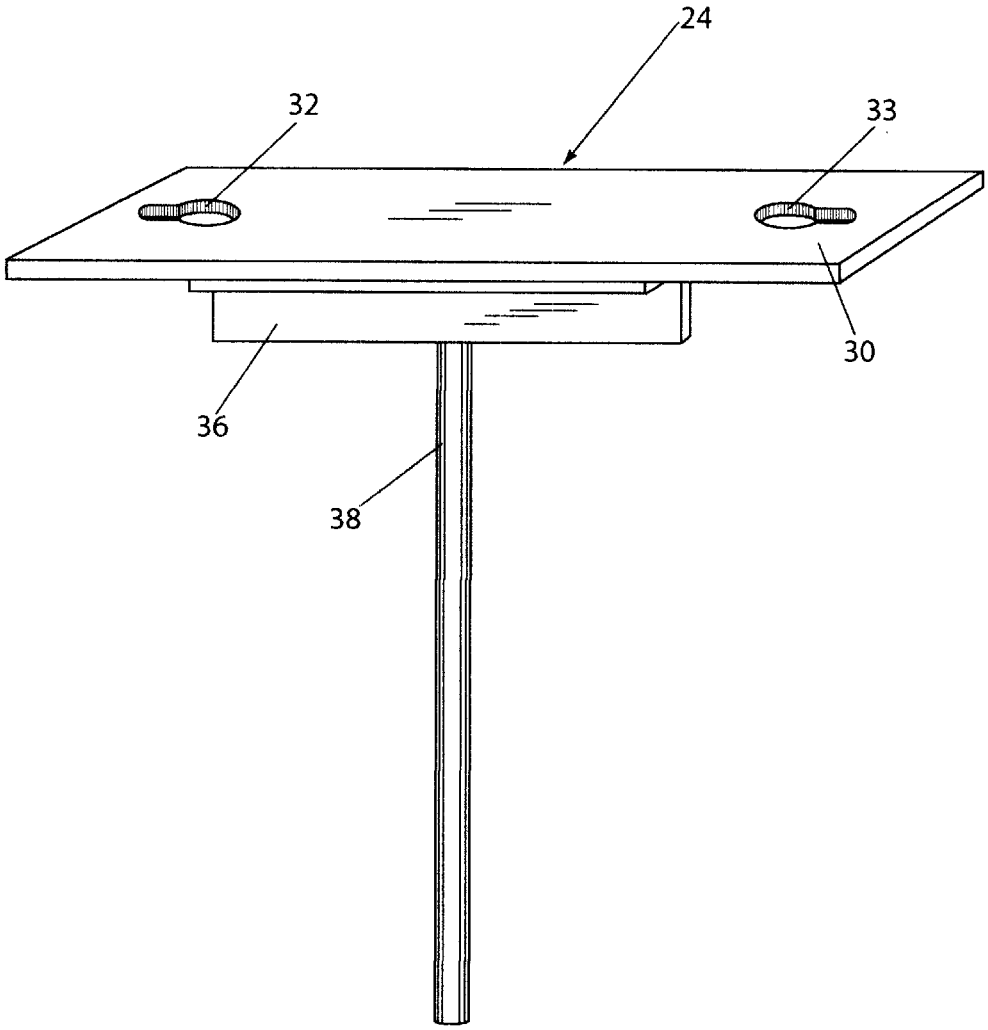
FIG. 5 is a perspective view of a 'T' base support assembly as in FIG. 1.

Referring more particularly to the drawings, FIG. 1 is a perspective view of a complete assembly of the preferred embodiment of the present invention. A base plate assembly 24 having a generally T-shaped configuration, provides rigid support for woodblock 90 in the preferred embodiment of the present invention. FIG. 5 is a perspective view of 'T' base support assembly 24. Assembly 24 includes a base plate 30, defining keyslot through-holes 32 and 33, 90° angle support 36, and round rod stem 38, the base plate being mounted atop the rod. The preferred assembly method of these components is welding. The preferred material is stainless steel although any suitable material may be used.

Dimensions of a given assembly could easily be determined by on skilled in the art by examining the size and shape of the instrument to be mounted. Musical woodblock 90 is held flexibly fast to base plate 30 by elastic tether 50. Woodblock 90 has a tether 50 on each end, one tether is visible in FIG. 1. Tether 50 draws woodblock 90 toward and into foam cradles 40 and 41, thereby slightly compressing foam cradles 40 and 41 while holding woodblock 90 in a playable position without rigidity and without direct contact between woodblock 90 in a playable position without rigidity and without direct contact between woodblock 90 and base plate 30. The dimensions of the complete assembled embodiment of the present invention change proportionately with the size of the musical instrument being mounted. Woodblock 90 in FIG. 1 is about 235 mm in length. It is understood that other hand-held percussion instruments may be supported by the present assembly and that these instruments are not a limitation of the present invention.

Figure 4:
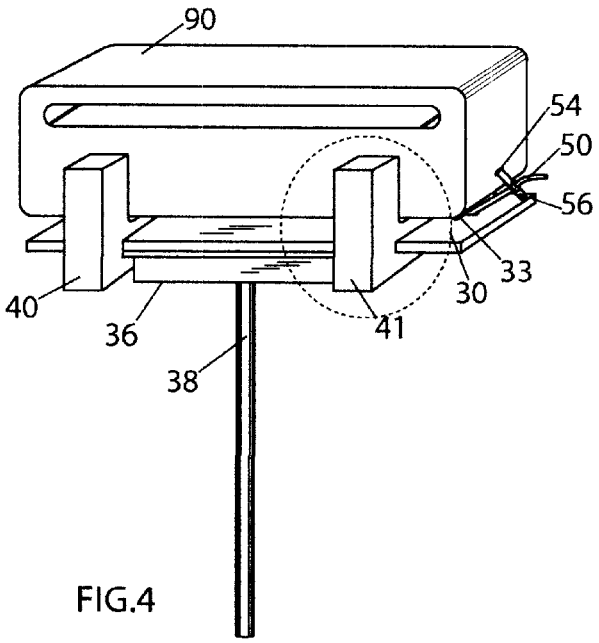
FIG. 4 is a perspective view of a complete assembly with an indicated detailed area.
Figure 4A:
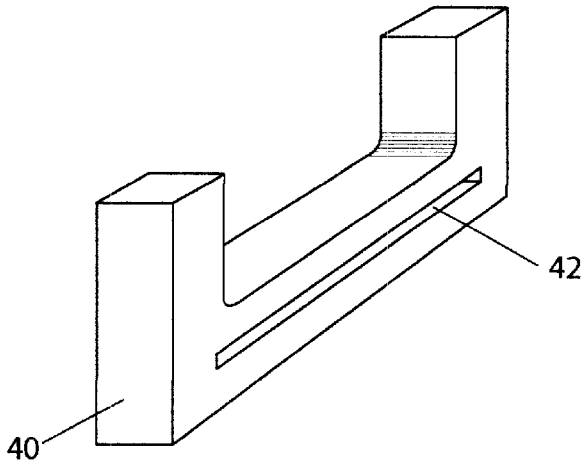
FIG. 4A is a perspective view of an isolated element indicated as a detail area from FIG. 4 comprising a U-shaped foam cradle.

The present invention can also comprise solely the connector means and vibration absorbing material without a definable rigid frame or support provided there is some means to otherwise support the musical instrument. Conversely, the sound absorbing cradles may be omitted so long as the instrument is adequately suspended from the frame. Woodblock 90 is free to resonate when mounted on vibration absorbing foam cradles 40 and 41. FIG. 4A is a perspective view of a U-shaped foam cradle. Foam cradles 40 and 41 are made of open or closed cell foam, preferably closed cell. Foam cradles 40 and 41 are identical in construction and shape, with through-slit 42 extending longitudinally along the lower portion of the cradle. Slit 42 allows base plate 30 In FIG. 1 to pass through foam cradles 40 and 41 for assembly. Foam cradles 40 and 41 are held in place by friction, provided slit 42 is sized correctly for a tight fit. Vertically upright ends of each cradle prevent woodblock 90 from sliding forward or backward when mounted and when being played. A tether assembly 28 connects woodblock 90 to 'T' base plate assembly 24.

Figure 2:
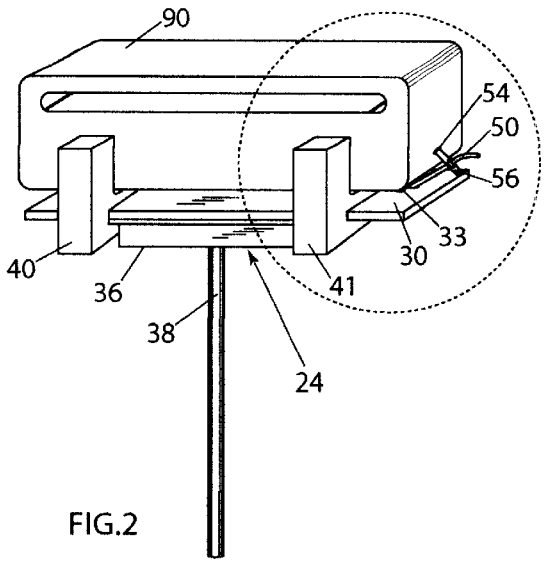
FIG. 2 is a fragmentary perspective view of a complete assembly as in FIG. 1 on an enlarged scale with indicated detailed area.
Figure 2A:
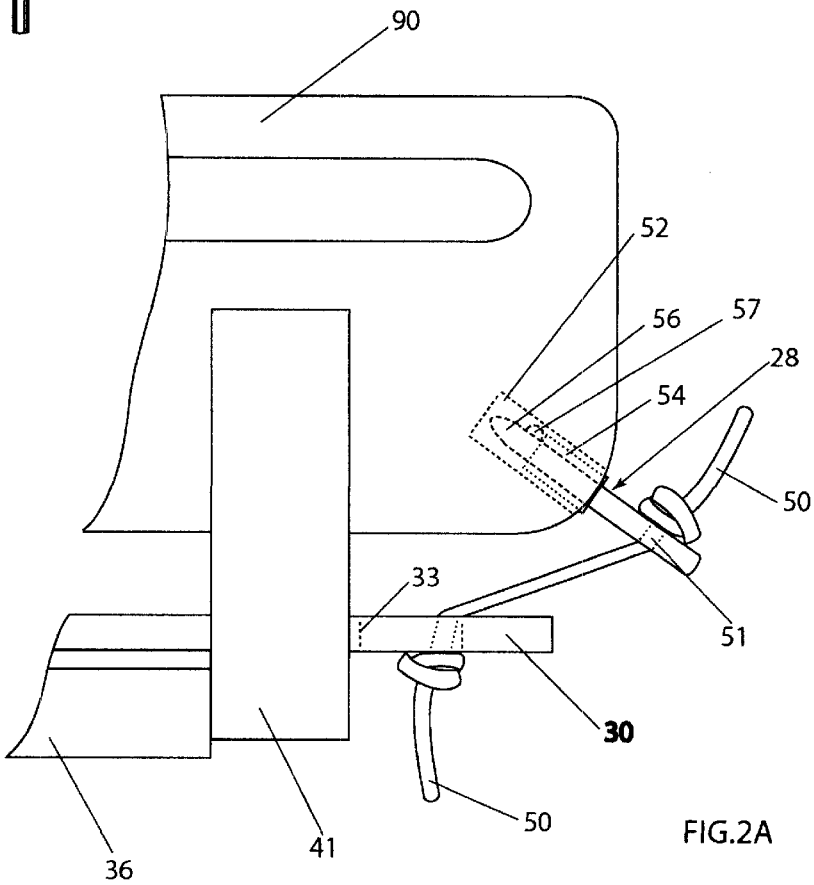
FIG. 2A is an enlarged frontal view of an indicated detail area from FIG. 2 comprising a tether assembly.
Figure 3:
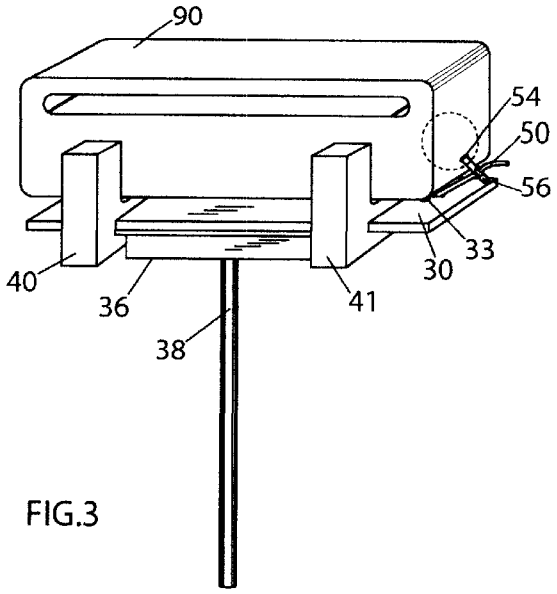
FIG. 3 is a perspective view of a complete assembly with indicated detail areas.
Figure 3A:
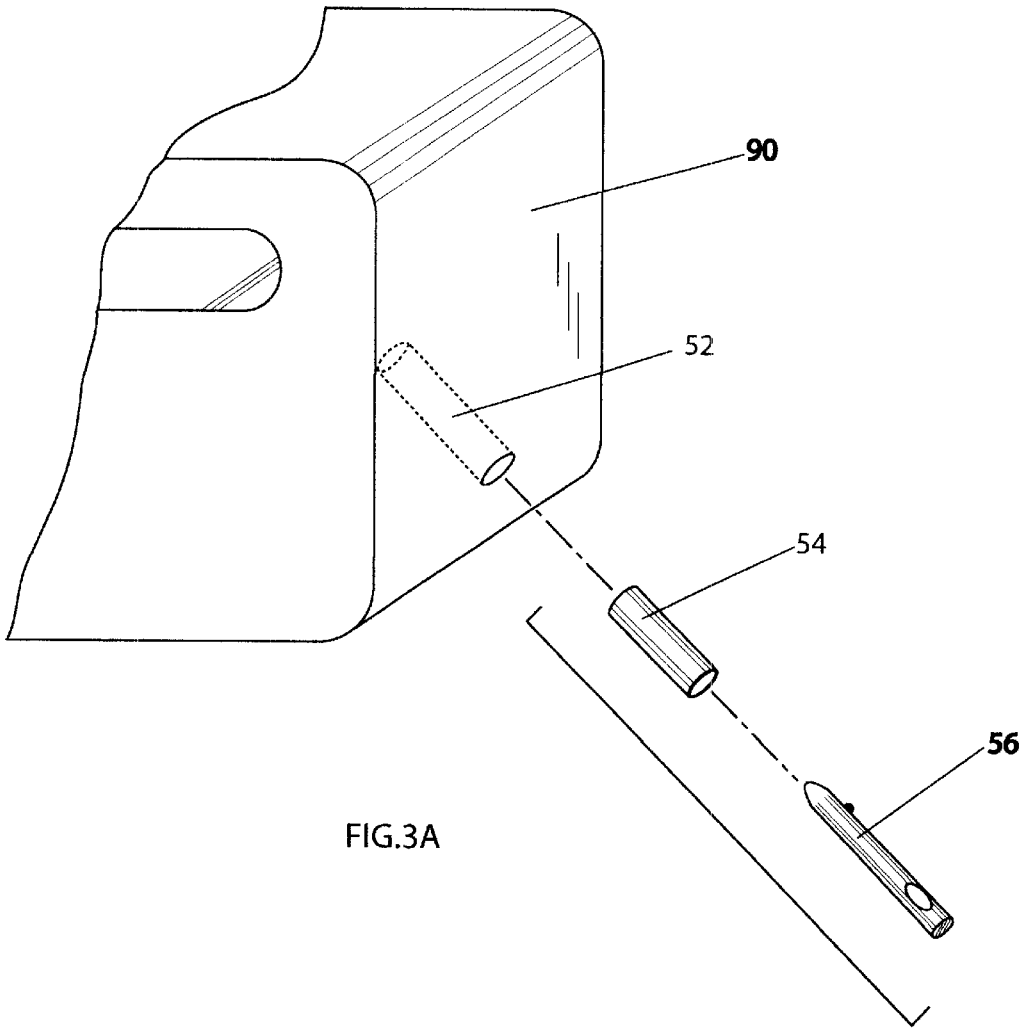
FIG. 3A is an enlarged perspective, exploded view of an indicated detail area from FIG. 3 comprising a detent pin assembly.

FIG. 2A is an enlarged frontal view of tether assembly 28. Assembly 28 includes elastic tether 50, drilled hole for detent pin 52, detent pin sleeve 54, and detent pin 56. In the preferred embodiment of the present invention two holes are drilled into woodblock 90, one on each lower end about mid-point along the lower edge radius, at about a 45° angle and about midway along the 'y' axis width of woodblock 90. FIG. 3 is a perspective view, exploded, of drilled hole 52, detent pin sleeve 54, and detent pin 56. The diameter of hole 52 must be sufficient to allow detent pin sleeve 54 to be glued into hole 52 with a snug fit. The depth of drilled hole 52 must be grater than the length of detent pin sleeve 54. When fully inserted, the length of detent pin sleeve 54 must be shorter than the length of detent pin 56 to allow detent pin 56 to be inserted to a depth sufficient to allow spring loaded ball 57 to expand into the full diameter of hole 52 and beyond the interior end of detent pin sleeve 54. In this way, tether assembly 28 will hold woodblock 90 for playing, but will be removable by the player by pulling detent pin 56 firmly away from woodblock 90. Other percussion instruments could be prepared similarly for use with this invention. Elastic tether 50 passes through-hole 51 in detent pin 56 and is knotted on one end above detent pin 56. Elastic tether 50 continues downward to and through support plate 30, passing through keyslot 33, and is pulled and elongated by stretching it's length during installation and is again knotted, thereby drawing woodblock 90 and base plate 30 toward each other, gently compressing foam cradle 41. Being fixed on each end, elastic tether 50 is captive between detent pin 56 and base plate 30. Woodblock 90 will not flexibly move laterally or vertically more than desired while being mounted and when being played. Material for detent pin 56 is preferably stainless steel, for detent pin sleeve 54 preferably garrolite tubing, and for elastic tether 50 preferably a multi-stranded elastic rubber cord with nylon sheath.

Alternate Embodiment—1

Figure 6:
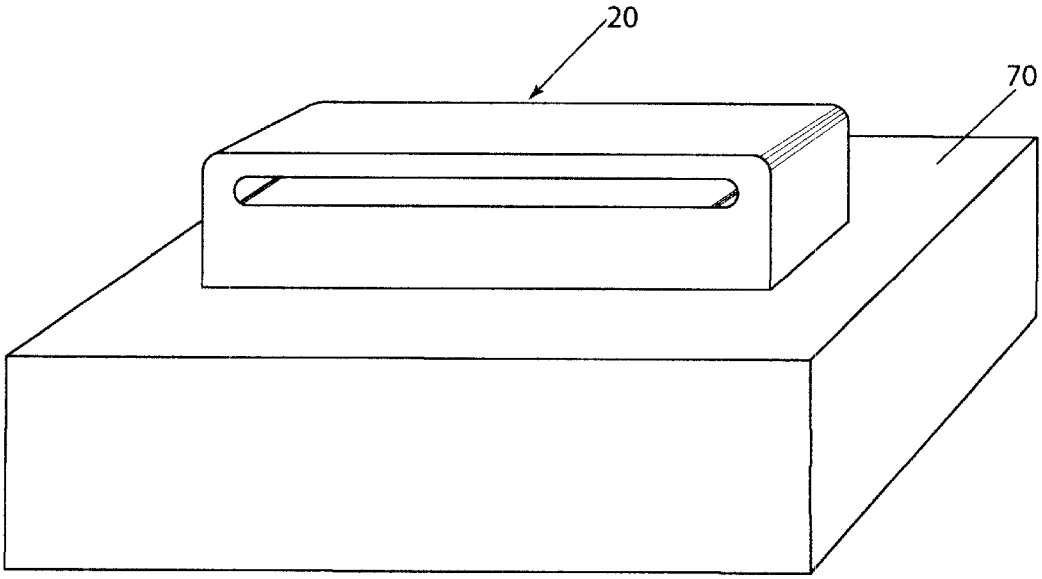
FIG. 6 is a perspective view of an alternate embodiment of the present invention.
Figure 7:
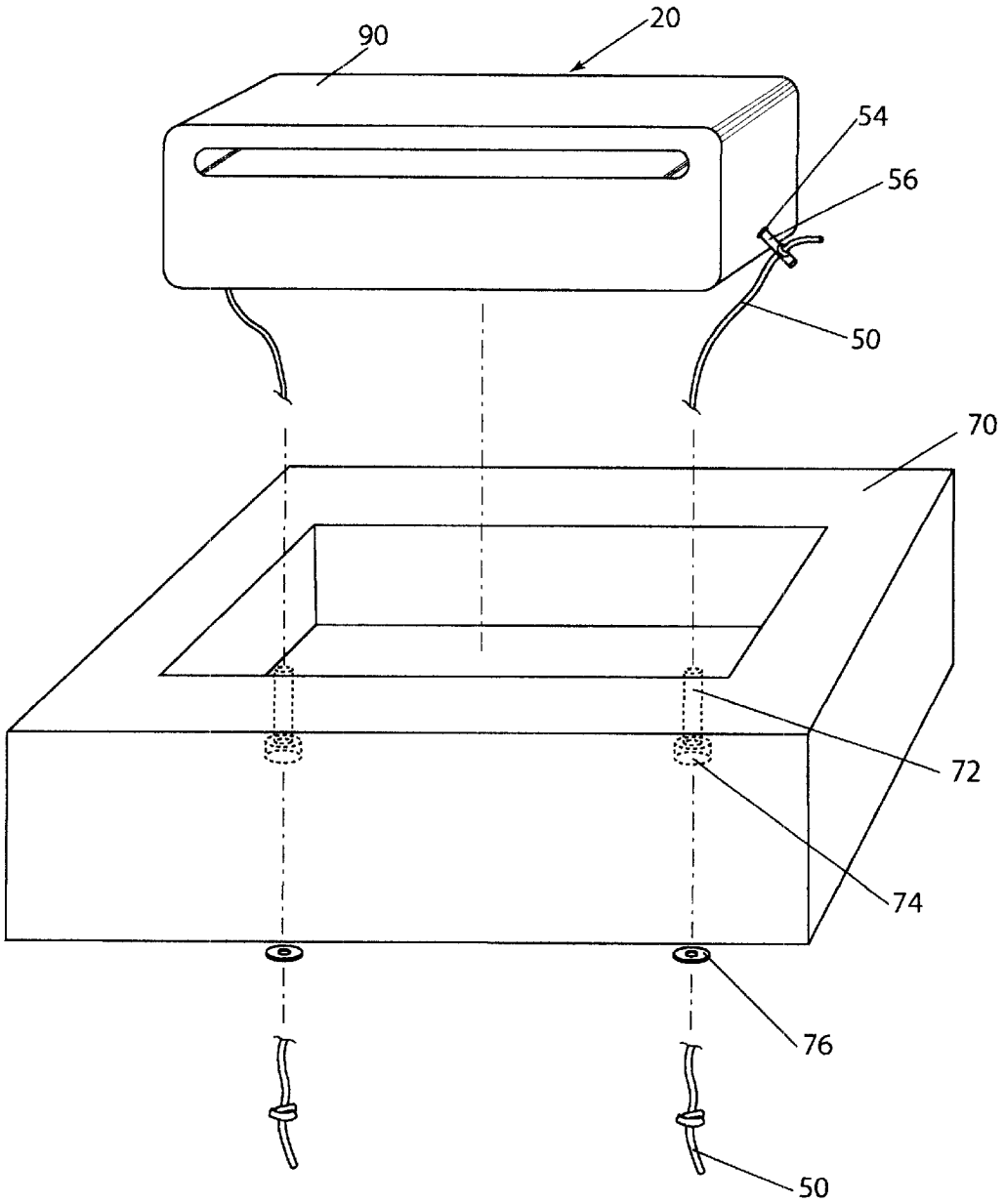
FIG. 7 is a perspective, exploded view of FIG. 6.

FIG. 6 is a perspective view of an alternate embodiment of the present invention of an assembly for supporting a musical woodblock, in a nested relationship in a solid foam block 70 with rectangular recess. Assembly 20 includes, musical woodblock 90, elastic tether 50 (two each), detent pin sleeve 54 (two each), detent pin 56 (two each). FIG. 7 is a perspective view, exploded, of FIG. 6. This embodiment of the present invention joins musical woodblock 90 and solid foam block 70 without a rigid frame by passing elastic tethers 50 through detent pins 56, (only one detent pin 56 visible in FIG. 7), and continuing with tethers downward through holes 72 and 74., continuing downward through washer 76, where elastic tethers 50 are pulled and elongated by stretching their length during installation and knotted beneath washers 76, thereby drawing woodblock 90 and solid foam block 70 toward each other gently compressing solid foam block 70. This renders woodblock 90 playable, free to resonate fully, in a flexibly fixed position for table-top performance.

Alternate Embodiment—2

Figure 8:
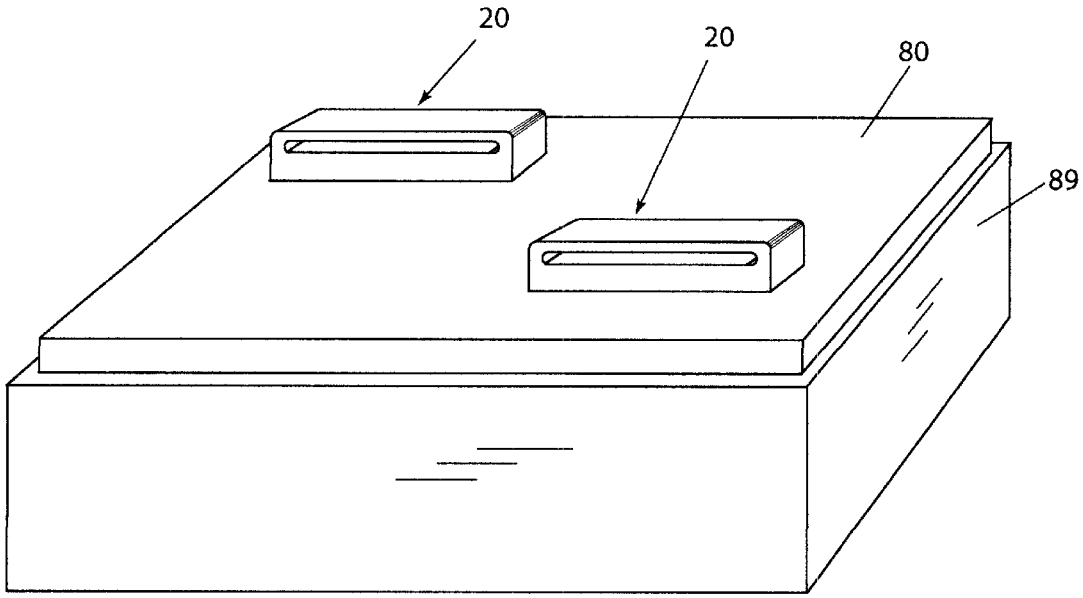
FIG. 8 is a perspective view of another embodiment of the present invention where instruments are playable on a flat plane housed in a rigid box.
Figure 9:
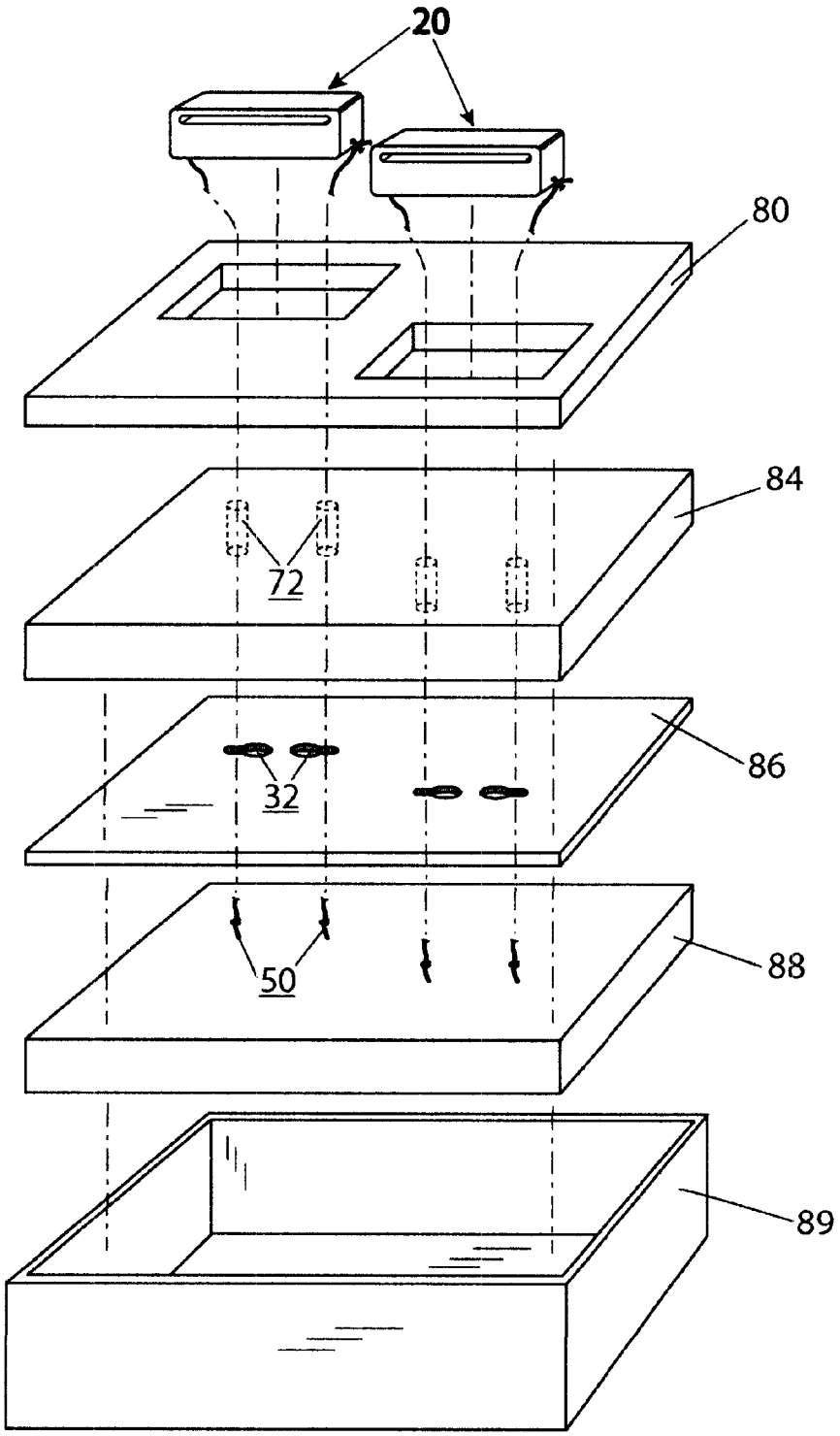
FIG. 9 is a perspective, exploded view of FIG. 8.

FIG. 8 is a perspective view of an alternate embodiment of the present invention where multiple musical woodblocks with attachment means, assembly 20, where assembly 20 includes musical woodblock 90, elastic tether 50 (two each), detent pin sleeve 54 (two each), detent pin 56 (two each), may be grouped, nested in uppermost panel 80 of a plurality of panels, 80, 84, 88 (only top panel 80 is visible in this view), and assembled in rigid case 89. FIG. 9 is a perspective, exploded view of FIG. 8 where multiple musical woodblocks with attachment means assembly 20, where each occurrence of assembly 20 includes musical woodblock 90, elastic tether 50 (two each), detent pin 56 (two each), are nested in a plurality of exploded view visible frame panels 80, 84, and 88, and including one rigid anchor panel 86, where all panels are stacked in 'sandwich' fashion into rigid box 89. This embodiment allows players to assemble multiple instruments in close proximity on a flat or nearly flat, moveable, portable plane and still allow free resonation of the instruments when played.

Conclusions, Ramification, And Scope

While the invention will be described in connection with a certain preferred embodiment, that is not intended to limit the invention to that particular embodiment. It is possible to apply the present invention to numerous other percussion instruments and achieve like results of greatly improved would quality, ease of use, and innovative flexibility in physical performance set up and player ergonomics. Therefore, it will be obvious that various changes and modifications may be made therein by those skilled in the art of such modifications without departing from the spirit and scope of the present invention.

What is claimed is:

1. A percussion instrument mounting apparatus, comprising:

a framework having an upstanding rod and a base plate mounted horizontally to an upper end of said rod, said framework having means connected to said base plate for displacing the percussion instrument from said base plate;

a flexible tether having a first end coupled to said base plate and a second end adapted to be releasably coupled to a percussion instrument, whereby to hold the percussion instrument in a position relative to said framework; and wherein said displacing means includes at least one cradle member constructed of a vibration absorbing material and having a generally U-shaped configuration, said at least one cradle member defining a slot for releasably coupling said at least one cradle member to said base plate, whereby the percussion member is supported by said at least one cradle member.

2. A percussion instrument mounting apparatus, comprising:

a support member constructed of a flexible, vibration absorbing material and having a configuration adapted to support a percussion instrument thereon;

an elastic tether having a first end coupled to said support member and a second end adapted to be releasably coupled to the percussion instrument for urging the percussion instrument against said support member, whereby to allow the percussion instrument to resonate freely when played; and wherein said support member includes a foam block defining a recess and having a bottom wall, said first end of said tether being coupled to said bottom wall, said recess being configured to receive the percussion instrument therein.

3. The apparatus as in claim 2 further comprising a framework, said framework including:

an upstanding rod having an upper end;

a base plate fixedly attached to said upper end of said rod and positioned perpendicular thereto for supporting said support member thereon.

4. The apparatus as in claim 2 wherein said support member includes a pair of cradle members, each cradle member having a U-shaped configuration adapted to hold the percussion instrument in a friction-fit relationship.

5. An apparatus for supporting a percussion instrument, comprising:

a framework having an upstanding rod and a base plate mounted horizontally to an upper end of said rod;

a support member constructed of a flexible, vibration absorbing material adapted to support the percussion instrument thereon; and wherein said support member includes a pair of cradle members, each cradle member having a U-shaped configuration for holding the percussion instrument in a friction-fit relationship.

6. The apparatus as in claim 5 further comprising an elastic tether having a first end coupled to said framework and a second end adapted to be releasably coupled to the percussion instrument for urging the percussion instrument against said support member.

7. The apparatus as in claim 5 wherein said support member includes a foam block defining a recess and having a bottom wall, said first end of said tether being coupled to said bottom wall, said recess being configured to receive the percussion instrument therein.

* * * * *